US006487739B1

(12) United States Patent
Harker

(10) Patent No.: US 6,487,739 B1
(45) Date of Patent: Dec. 3, 2002

(54) MOISTURE DRYING MATTRESS WITH SEPARATE ZONE CONTROLS

(75) Inventor: Ruth Harker, St. Louis, MO (US)

(73) Assignee: Crown Therapeutics, Inc., Belleville, IL (US)

( * ) Notice: Subject to any disclaimer, the term of this patent is extended or adjusted under 35 U.S.C. 154(b) by 0 days.

(21) Appl. No.: 09/584,867

(22) Filed: Jun. 1, 2000

(51) Int. Cl.[7] ..... A47C 21/04; A47C 27/10; A61G 7/057

(52) U.S. Cl. ..... 5/726; 5/423; 5/706; 5/710; 5/714; 5/914; 5/699; 5/737

(58) Field of Search ..... 5/726, 722, 724, 5/727, 728, 706, 707, 710, 713, 714, 737, 738, 421, 423, 484, 699, 652.1, 652.2, 654, 655.3, 657, 914, 935, 944, 485

(56) References Cited

U.S. PATENT DOCUMENTS

| | | | | | |
|---|---|---|---|---|---|
| 853,049 | A | * | 5/1907 | Weston | 5/738 |
| 1,123,345 | A | * | 1/1915 | Micon | 5/738 X |
| 1,579,074 | A | * | 3/1926 | Burton | 5/727 X |
| 1,914,661 | A | * | 6/1933 | Burke | 5/738 X |
| 2,493,067 | A | * | 1/1950 | Goldsmith | 5/726 |
| 2,913,833 | A | * | 11/1959 | Glintz | 5/421 X |
| 3,209,380 | A | * | 10/1965 | Watsky | 5/724 |
| 3,266,064 | A | * | 8/1966 | Figman | 5/726 |
| 3,605,145 | A | | 9/1971 | Graebe | 5/706 |
| 3,653,083 | A | * | 4/1972 | Lapidus | 5/714 X |
| 3,681,797 | A | | 8/1972 | Messner | 297/180.13 |
| 3,778,851 | A | * | 12/1973 | Howorth | 5/714 X |
| 3,870,450 | A | | 3/1975 | Graebe | 425/269 |
| 4,005,236 | A | | 1/1977 | Graebe | 428/72 |
| 4,225,989 | A | * | 10/1980 | Corbett et al. | 5/714 X |
| 4,279,044 | A | * | 7/1981 | Douglas | 5/714 |
| 4,347,633 | A | * | 9/1982 | Gammons et al. | 5/714 X |
| 4,365,371 | A | * | 12/1982 | Boussaroque | 5/738 X |

(List continued on next page.)

FOREIGN PATENT DOCUMENTS

| | | | | | |
|---|---|---|---|---|---|
| AU | 221200 | B | * | 9/1957 | 5/738 |
| DE | 3320771 | A1 | * | 12/1984 | 5/714 |
| GB | 2161376 | A | * | 1/1986 | 5/724 |
| GB | 2 032 269 | A | | 5/1990 | |
| GB | 2225229 | A | * | 5/1990 | 5/724 |
| GB | 2244000 | A | * | 11/1991 | 5/737 |
| IT | 626272 | B | * | 10/1961 | 5/714 |
| JP | 405015557 | A | * | 1/1993 | 5/710 |
| WO | WO 4548 | | * | 6/1988 | 5/421 |

OTHER PUBLICATIONS

Huntleigh Technology—Relieving The Pressure—Alphacare Sep. 1998.

(List continued on next page.)

*Primary Examiner*—Robert G. Santos
(74) *Attorney, Agent, or Firm*—Polster, Lieder, Woodruff & Lucchesi, L.C.

(57) ABSTRACT

A moisture drying mattress comprises a cover that encloses an air cell mattress and a plurality of air channel mats. The cover has a top portion that is vapor permeable and liquid impermeable. The air cell mattress has a plurality of apertures between the air cells. The plurality of air channel mats have a base and are positioned beneath the air cell mattress and within pockets located in the interior of the cover on a bottom portion of the cover. The air channel mats have a plurality of projections extending upwardly from the base that support the air cell mattress in a spaced relation from the air channel mat base. The air channel mats communicate with an air pump that is selectively controlled by a controller to selectively supply a flow of air to any of the air channel mats. The air flow to the air channel mats flows over the base of the air channel mats between the projections and upwardly through the plurality of apertures in the air cell mattress and through the cover top portion to remove moisture from the mattress and from the interface between a user of the moisture drying mattress and the top cover.

21 Claims, 6 Drawing Sheets

U.S. PATENT DOCUMENTS

| | | | | | |
|---|---|---|---|---|---|
| 4,391,009 | A | * | 7/1983 | Schild et al. | 5/714 X |
| 4,472,847 | A | * | 9/1984 | Gammons et al. | 5/714 X |
| 4,541,136 | A | | 9/1985 | Graebe | 5/655.3 |
| 4,599,756 | A | * | 7/1986 | Koffler | 5/484 X |
| 4,605,582 | A | | 8/1986 | Sias et al. | 428/120 |
| 4,622,706 | A | | 11/1986 | Takeuchi | 5/713 |
| 4,673,605 | A | | 6/1987 | Sias et al. | 428/120 |
| 4,698,864 | A | | 10/1987 | Graebe | 5/654 |
| 4,825,488 | A | * | 5/1989 | Bedford | 5/726 |
| 4,847,933 | A | * | 7/1989 | Bedford | 5/652.2 |
| 4,864,671 | A | | 9/1989 | Evans | 5/713 |
| 4,866,800 | A | * | 9/1989 | Bedford | 5/652.1 |
| 4,949,412 | A | * | 8/1990 | Goode | 5/914 X |
| 4,969,223 | A | * | 11/1990 | Yamaguchi | 5/738 X |
| 4,982,466 | A | | 1/1991 | Higgins et al. | 5/713 |
| 4,986,738 | A | | 1/1991 | Kawasaki et al. | 417/304 |
| 5,002,336 | A | * | 3/1991 | Feher | 5/421 X |
| 5,052,068 | A | | 10/1991 | Graebe | 5/654 |
| 5,062,169 | A | * | 11/1991 | Kennedy et al. | 5/713 |
| 5,085,653 | A | * | 2/1992 | Levy | 604/358 |
| 5,090,076 | A | * | 2/1992 | Guldager | 5/713 |
| 5,111,544 | A | | 5/1992 | Graebe | 5/654 |
| 5,129,115 | A | * | 7/1992 | Higgins et al. | 5/713 |
| 5,152,023 | A | | 10/1992 | Graebe | 5/655.3 |
| 5,163,196 | A | | 11/1992 | Graebe | 5/654 |
| 5,193,237 | A | * | 3/1993 | Holdredge | 5/654 |
| 5,249,318 | A | * | 10/1993 | Loadsman | 5/710 |
| 5,265,933 | A | * | 11/1993 | Croshaw | 297/228.1 |
| 5,274,846 | A | | 1/1994 | Kolsky | 2/460 |
| 5,369,828 | A | | 12/1994 | Graebe | 5/654 |
| 5,373,595 | A | * | 12/1994 | Johnson et al. | 5/710 |
| 5,379,471 | A | * | 1/1995 | Holdredge | 5/655.3 |
| 5,416,935 | A | * | 5/1995 | Nieh | 5/423 |
| 5,444,881 | A | * | 8/1995 | Landi et al. | 5/655.3 X |
| 5,474,361 | A | * | 12/1995 | Hwang et al. | 5/654 X |
| 5,493,742 | A | | 2/1996 | Klearman | 5/423 |
| 5,502,855 | A | * | 4/1996 | Graebe | 5/710 X |
| 5,509,155 | A | * | 4/1996 | Zigarac et al. | 5/655.3 |
| 5,533,217 | A | * | 7/1996 | Holdredge | 5/914 X |
| 5,533,220 | A | * | 7/1996 | Sebag et al. | 5/654 |
| 5,539,942 | A | * | 7/1996 | Melou | 5/655.3 |
| 5,561,875 | A | | 10/1996 | Graebe | 5/423 |
| 5,590,428 | A | * | 1/1997 | Roter | 5/726 |
| 5,596,778 | A | * | 1/1997 | Suzuki et al. | 5/423 X |
| 5,596,781 | A | | 1/1997 | Graebe | 5/710 |
| 5,640,728 | A | | 6/1997 | Graebe | 5/606 |
| 5,645,314 | A | * | 7/1997 | Liou | 5/423 X |
| 5,655,237 | A | * | 8/1997 | Suzuki et al. | 5/423 X |
| 5,687,438 | A | * | 11/1997 | Biggie et al. | 5/654 |
| 5,689,845 | A | | 11/1997 | Sobieralski | 5/654 |
| 5,699,570 | A | | 12/1997 | Wilkinson et al. | 5/713 |
| 5,701,621 | A | * | 12/1997 | Landi et al. | 5/652.1 X |
| 5,715,695 | A | * | 2/1998 | Lord | 5/421 X |
| 5,745,941 | A | * | 5/1998 | Miller, Jr. | 5/710 |
| 5,787,534 | A | * | 8/1998 | Hargest et al. | 5/726 |
| 5,794,288 | A | * | 8/1998 | Soltani et al. | 5/714 X |
| 5,836,027 | A | * | 11/1998 | Leventhal et al. | 5/706 |
| 5,839,140 | A | * | 11/1998 | Wilkerson | 5/654 |
| 5,887,304 | A | * | 3/1999 | von der Heyde | 5/726 |
| 5,902,011 | A | | 5/1999 | Hand et al. | 297/284.6 |
| 5,926,884 | A | * | 7/1999 | Biggie et al. | 5/714 |
| 6,014,784 | A | * | 1/2000 | Taylor et al. | 5/713 |
| 6,052,853 | A | * | 4/2000 | Schmid | 5/726 |
| 6,108,843 | A | * | 8/2000 | Suzuki et al. | 5/713 |
| 6,178,578 | B1 | * | 1/2001 | Soltani et al. | 5/713 |
| 6,212,718 | B1 | * | 4/2001 | Stolpmann et al. | 5/713 |
| 6,274,520 | B1 | * | 8/2001 | Cordell | 442/381 |
| 6,317,912 | B1 | * | 11/2001 | Graebe et al. | 5/710 |
| 6,336,237 | B1 | * | 1/2002 | Schmid | 5/726 |
| 6,370,718 | B1 | * | 4/2002 | Schmid | 5/726 |

OTHER PUBLICATIONS

Mellen Air Manufacturing, Inc.—REM–AIR The One Piece Low Air Loss Mattress System.

Plexus Medical—CareMedx Multi–Zone Microprocessor Controlled Low Air Loss Therapy.

Progressive Medical Technology, Inc.—BASE Large Cell Low Air Loss Alternating Pressure System Sep. 1994.

Talley Medical—QU4TRO DEEP CELL Sequential Anti–Decubitus Mattress Replacement Systems 1994.

Bio Clinic—The ProAire Portable Rotation System 1993.

Therapy Concepts, Inc.—The StageZero AL–1A Power Air Flotation Bed System—AIR SUPERIORITY.

Lumex, Inc.—ClassicAir AkroTech May 1995.

KCI—Maximizing patient care through appropriate service and product selection Aug. 1994.

James Consolidated, Inc.—The Volkner System—Mark II low air loss MATTRESS REPLACEMENT.

Integrated Therapy Products, Inc.—Aeromat MRS–1000,—Creative solutions for cost–effective wound care management 1992.

Innovative Medical Systems, Inc.—The Bazooka System.

Sunrise Medical/Bio Clinic—Orthoderm Therapy Products.

KCI—Home Kair Bed–Low Air Loss, Pressure Relief Therapy HOMEDCO 1997.

Hill–Rom Home Care—Silkar Low Airloss Therapy.

Health Products, Inc.—Orthoderm Convertible.

Special Care Delivery—Pneu–Care Plus +.

Clinicare Systems, Inc.—Clini–Care Apr. 1990.

Compass Wound Care Network—Air Matt—Non Powered Adjustable Zone Mattress Overlay.

Dermanet—AirBed 1000.

Apex Health Care Mfg., Inc.—"Elite" Alternating Therapy Air Pump and Super Low Air Loss Mattress.

American Bantex—Alternating Pressure Pump & Mattress System.

Anatomic Therapy Systems—Conforma Aire The Portable Therapy Bed.

Anatomic Therapy Systems—NatureSleep Aire The Portable Therapy Bed.

National Patient Care Systems, Inc.—ALAMO Alternating Low Airloss Mattress Overlay 1990.

DynaMedics Corporation—ASAP Air Suspension and Pulsation Therapy System Mar. 1995.

GSI Medical Systems—microAIR 1000 Portable Air Loss Therapy System 1989.

Gaymar Industries, Inc.—SPR Plus Low Air Loss Therapy 1992.

Progressive Medical Technology, Inc.—BASE Deep Cell Low Air Loss Alternating Pressure Mattress Dec. 1994.

Major Causes of Pressure Ulcers brochure.

Pressure Ulcers and Patient Support Surfaces, a brief tutorial by Oliver H. Bodine, Jr., President, GSI medical Systems, Inc.

* cited by examiner

MOISTURE DRYING MATTRESS WITH SEPARATE ZONE CONTROLS

BACKGROUND OF THE INVENTION (i) Field of the Invention

The present invention relates in general to cushioning devices, in particular to a mattress comprised of an air cell mattress with a plurality of apertures extending through the base of the air cell mattress, a plurality of air channel mats residing beneath the air cell mattress, a top and bottom cover, and an air pump with a controller. The air pump communicates with the air channel mats to provide a flow of air to the bottom of the air cell mattress which flows upwardly through the plurality of apertures and through the top cover to remove moisture. These cushioning devices are typically used in a hospital setting for users that are severely disabled or debilitated and readily cannot move.

(ii) Description of the Related Art

Over the years various mattresses for use in therapeutic care and the prevention of pressure ulcers on the user of the mattress have been developed. Pressure ulcers are red areas or open sores on the skin, often accompanied by indications that the skin and surrounding tissue is in the process of dying and decomposing. Pressure ulcers are caused by restricted blood flow causing damage to the body's soft tissue in areas where bone is close to the skin. Pressure ulcers, also known as bed sores, can occur over any boney part of the body such as the heels, hips and back. Users who are severely disabled, diabetic or debilitated and cannot move are ideal candidates for developing pressure ulcers. These users are apt to lie or sit motionless in one position for long periods of time (hours). The major causes of pressure ulcers include (1) oxygen and nutrient starvation of the soft tissue; (2) pressure; (3) friction and skin shear; (4) excess moisture or moisture build-up at the skin; and (5) heat build-up in the tissue. Pressure at the user-mattress interface can constrict capillary blood flow due to soft tissue deformation and starve body tissue of oxygen and nutrients. The starvation of the tissue causes the tissue to began to die and decompose, causing the formation of a pressure ulcer.

While the interface pressure is very important, other factors also contribute to developing pressure ulcers. Friction and skin shear forces intensify the damaging effects of interface pressure. Friction results in abrasion damage to the skin surface. Skin shear is the horizontal force between the user and the mattress surface that produces tearing forces within deeper tissues. Skin shear can occur when a user is positioned or slides on a bed surface, stretching and damaging skin, connective-tissue, muscle and blood vessels. Excess moisture or moisture build-up at the user-mattress interface can be absorbed through the skin and possibly result in over-hydration of the skin. Over-hydration of the skin dramatically reduces soft tissue strength and increases the potential for friction/shear damage. Excess moisture on the mattress also raises the drag friction of the user-mattress interface due to liquid surface tension and can greatly increase friction and shear damage. Another factor contributing to the development of pressure ulcers is heat build-up in the tissue. Elevated tissue temperatures increase cellular metabolism and the subsequent need for oxygen and nutrients. Typically, the prior art mattresses designed to prevent pressure ulcers employ some type of air cell mattress wherein the individual air cells communicate with one another so as to evenly distribute the supporting force over the body of the user of the mattress. While the use of mattresses that provide a uniform supporting force reduces the possibility of developing pressure ulcers, other factors need to be addressed in order to further diminish the possibility of a user developing pressure ulcers.

For example, excess moisture or moisture build-up at the user-mattress interface can result in over-hydration (or maceration)of the skin along with an increase in the friction and skin shear forces experienced by the user, which greatly enhance the potential for developing pressure ulcers. To overcome the excess moisture build-up, prior art mattresses have employed methods of providing a flow of air through the mattress and along the user-mattress interface to remove any built-up moisture and minimize the potential for moisture to build-up. These mattresses included the use of an air pump to supply a flow of air to an air distribution member residing beneath the mattress which flows between the air distribution member and the mattress and then upwardly through the mattress to the user-mattress interface. These prior art mattresses use a single air distribution member to provide the flow of air to the mattress. However, these mattresses had a drawback in that, the use of a single air distribution member does not provide the flexibility to custom tailor the flow of air to different parts of the mattress to provide different levels of comfort and moisture removal for the user of the mattress.

Typical prior art mattresses also employ a single air pump to supply air to both the air cells and the air distribution member. The use of a single pump to provide air to the air cells of the air cell mattress and to provide a flow of air to the mattress air distribution member to remove moisture increases the complexity and cost of the air supply system and prevents the use of other manufacture's air cell mattresses. The complexity of the air supply system for both the mattress air cells and the air distribution member may also be difficult for a user to understand and control.

Some prior art mattresses utilize air from the air cells to provide a flow of air from the mattress to remove moisture. A typical mattress of this type uses low air loss air cells wherein the air cells are constantly venting a small amount of air out of the air cells as new air is being continuously pumped into the air cells. The air venting from the air cells provides the air flow to the mattress to remove the moisture. Additionally, other mattresses systematically inflate and deflate some of the air cells of the air cell mattress in order to relieve pressure on the user of the mattress. The deflation of the air cells provides an exhaust flow of air that is routed from the mattress to remove moisture therefrom.

Some prior art mattresses also utilize drainage holes in the mattress to remove large amounts of liquid that may be excreted by a user of the mattress, such as urine. While this aids in the removal of the liquid moisture, it does not remove moisture vapor and allows for a potentially unsanitary and non-hygenic mattress.

The use of this type of mattress requires the mattress to be cleaned and disinfected after having been contaminated.

SUMMARY OF THE INVENTION

The present invention overcomes shortcomings of prior art mattresses by providing a cushion that provides a uniform supporting force over a large area, an air channel mat for supplying air to the mattress to dry moisture vapor, and a cover that provides a smooth surface for the user to lay on that is vapor permeable and liquid impermeable. Furthermore, the present invention provides for a plurality of air channel mats that are supplied with a flow of air from an air pump that can selectively control which parts of the mattress are supplied with a flow of air to dry moisture vapor.

An effective therapeutic mattress that minimizes the possibility of pressure ulcers will (1) distribute pressure as evenly as possible along a user's body minimizing or eliminating the potential of soft tissue deformation; (2) have a low friction user-mattress interface that minimizes the skin shear forces; and (3) actively removes excess user-mattress moisture.

The moisture drying mattress is comprised of at least one cushion that has opposite top and bottom surfaces and a plurality of apertures that extend through the cushion from the bottom surface to the top surface. An air channel mat is positioned below the cushion. The air channel mat is adapted and dimensioned to fit beneath the cushion and support the cushion bottom surface in a spaced relation above a bottom base of the mat to thereby form an air channel between the cushion and mat through which air can flow. An air pump is provided for selectively supplying a flow of air to the air channel mat. A controller is provided to control the flow of air to the air channel mat. A cover encases the air channel mat and the cushion.

In the preferred embodiment, the cushion is an inflatable air cell mattress comprised of a plurality of air cells. The air cells are interconnected to permit air flow between the air cells and are preferably cubic in shape with a domed top. The inflated air cell mattress provides a uniform supporting force for the user of the mattress to minimize the pressure concentrations on the user. The distribution of the supporting force helps to prevent the occurrence of pressure ulcers. A plurality of apertures are provided in the cushion that extend through the base sheet and top sheet of the air cell mattress but do not communicate with the air cells. The apertures provide a path through which air can flow from the air channel mat upwardly through the apertures and between the air cells and through the cover to remove moisture or dry the moisture vapor.

In the preferred embodiment, the air channel mat is a plurality of air channel mats that are each dimensioned and adapted to fit beneath a portion of the cushion and support the cushion bottom surface in a spaced relation above the base of the air channel mat. The air channel mats each have a peripheral edge separating opposite top and bottom surfaces of the base. An air supply connector is connected to each air channel mat along its peripheral edge. A plurality of projections extend upwardly from the base top surface of each air channel mat and engage with the cushion bottom surface to support the cushion bottom surface in a spaced relation above the base top surface and create a channel into which air can flow between the air channel mat base and the cushion bottom surface. Preferably, each air channel mat is also provided with a skirt that extends along a portion of the air channel mat peripheral edge. The skirt extends over the air supply connector and along a portion of the peripheral edge on both sides of the air supply connector. The skirt extends inwardly from the peripheral edge to cover a portion of the top surface of the base and the projections that extend upwardly from the base. The skirt serves to secure the air supply connector to the air channel mat and prevents the flow of air to the air channel mat from escaping along the portion of the peripheral edge with the skirt.

In the preferred embodiment, the air pump has a plurality of air outlets, with each outlet being controlled by a valve that is selectively positionable between opened and closed positions. The outlets are connected with the air supply connectors of the air channel mats, with each outlet being associated with one air channel mat and providing a flow of air from the air pump to the associated air channel mat when in the opened position. When the valves are in the closed position they prevent a flow of air from the air pump outlets to their associated air channel mats. The valves thereby allow a user to selectively choose which air channel mats receive a flow of air from the air pump.

In the preferred embodiment, the air pump includes an air supply controller that controls the valves and the air pump and has a plurality of selectively adjustable inputs, the inputs controlling the opening and closing of the valves and the operation of the air pump. The inputs control a cyclic opening and closing of the valves for predetermined periods of time. The selectively adjustable inputs thereby enable a user to custom tailor the air flow to the mattress and the subsequent moisture removal.

In the preferred embodiment, the cover is dimensioned and adapted to enclose the cushion and the air channel mats. The cover has a top sheet with a peripheral edge and a bottom sheet with a peripheral edge. The top and bottom sheets are connected together along portions of their peripheral edges, leaving an opening between the peripheral edges that provides access to an interior of the cover between the top sheet and bottom sheet.

Preferably, the bottom sheet has opposite top and bottom surfaces. The bottom sheet top surface has a plurality of pockets dimensioned and adapted to receive the air channel mats. The pockets are comprised of a U-shaped frame having an outer peripheral edge, an inner peripheral edge, and a margin extending between the outer and inner peripheral edges. The outer peripheral edge is secured to the bottom sheet top surface and the frame margin of the pocket overlaps a portion of the top of the air channel mat, thereby holding the air channel mat in the pocket. A portion of the air channel mat beneath the frame opening is exposed to the cushion bottom surface so that the mat projections engage with the cushion bottom surface to support the cushion bottom surface in a spaced relation above the air channel mat base.

Preferably, each pocket separates each of the air channel mats and forms a seal between the pocket and the cushion bottom surface. The seal directs the flow of air from the air pump through the air channel mat and then upwardly through the apertures in the portion of the cushion that is above the air channel mat, enabling the flow of air to be directed to the desired portion of the cushion.

In the preferred embodiment, the top sheet of the cover has a top surface, upon which the user will interface with the mattress, that is both vapor permeable and liquid impermeable. The top sheet is comprised of a nylon sheet laminated to a urethane sheet. The nylon sheet is above the urethane sheet so that a user of the mattress will interface with the nylon sheet and the urethane sheet is positioned between the nylon sheet and the cushion top surface. The laminated top sheet allows moisture vapor to permeate both into and out of the cover and prevents liquid on the top surface of the cover from entering the mattress and contaminating the cushion and air channel mats. The use of a nylon sheet as the interface between the mattress and the user reduces the friction between the cover and the user and thereby minimizes the possibility of the user developing pressure ulcers from friction or skin shear. Additionally, by utilizing a flow of air through the cover top sheet to remove the moisture vapor from the mattress-user interface, the user's skin is less likely to over-hydrate (maceration) and as a result the soft tissue is strong enough to reduce the potential for friction and/or skin shear damage.

The moisture drying mattress of the present invention overcomes the disadvantages of the prior art. The use of a plurality of air channel mats that can be selectively supplied with a flow of air from an air pump allows the user to selectively choose which portions of the mattress receive the air flow The use of a cover having a top surface upon which the user will interface that is made of a nylon sheet laminated to a urethane sheet keeps liquids out of the mattress while allowing the air flow within the mattress to flow through the cover and remove moisture. The nylon surface provides a smooth, low friction surface upon which the user interfaces with the mattress and reduces the risk of damage to a user's skin. Additionally, the removal of moisture from the user-mattress interface will also remove heat from the user's skin via evaporative cooling and, accordingly, reduce the risk of developing pressure ulcers. The use of an air mattress that distributes a supporting force over the entire portion of the user's body that is in contact with the mattress minimizes or eliminates the potential of soft tissue deformation and further reduces the possibility of developing pressure ulcers.

BRIEF DESCRIPTION OF THE DRAWINGS

Further objectives and features of the present invention are set forth in the following detailed description of the preferred embodiment of the invention and in the drawing figures wherein.

DETAILED DESCRIPTION OF THE INVENTION

Figure 1:
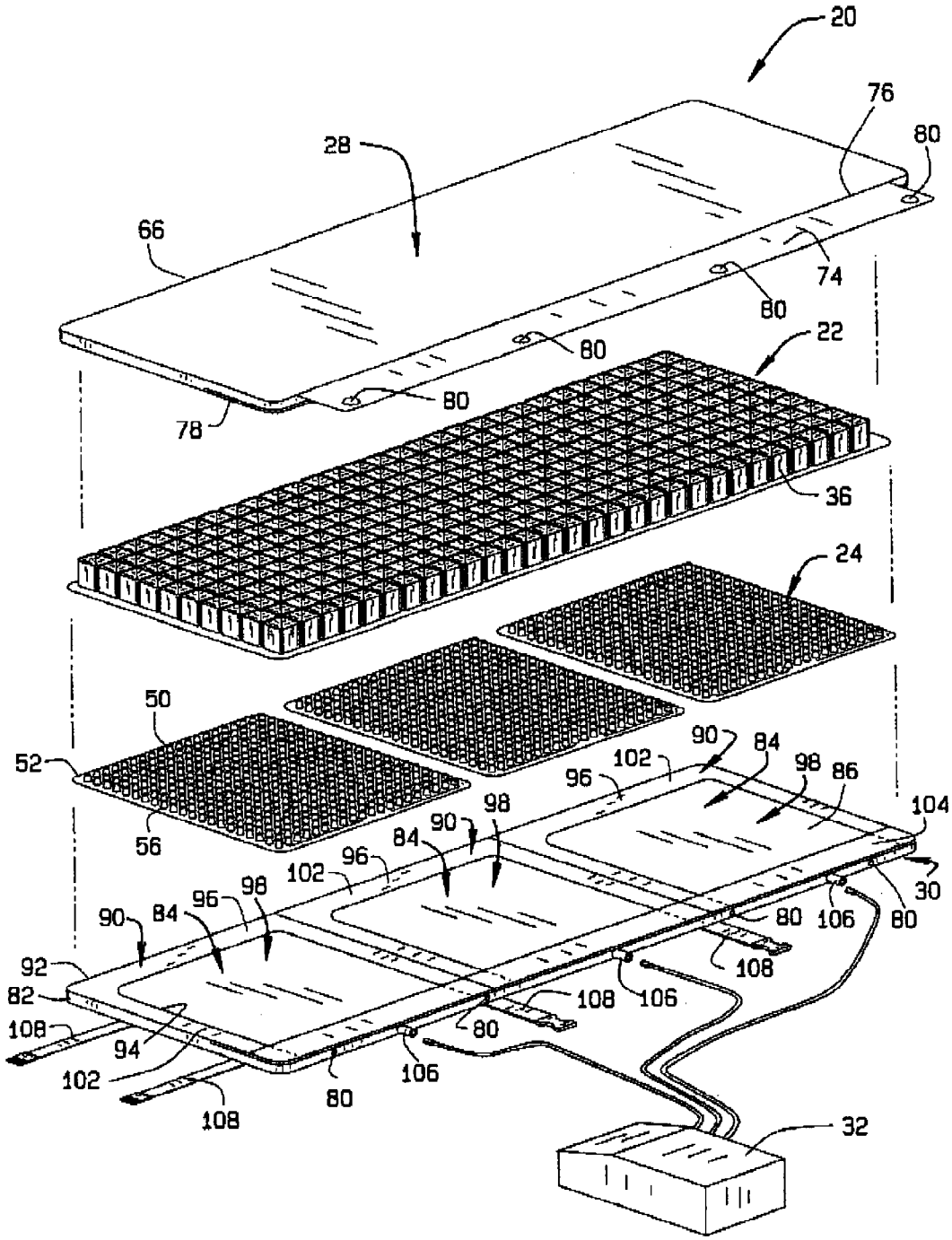
FIG. 1 is a perspective, exploded view of the mattress.
Figure 2:
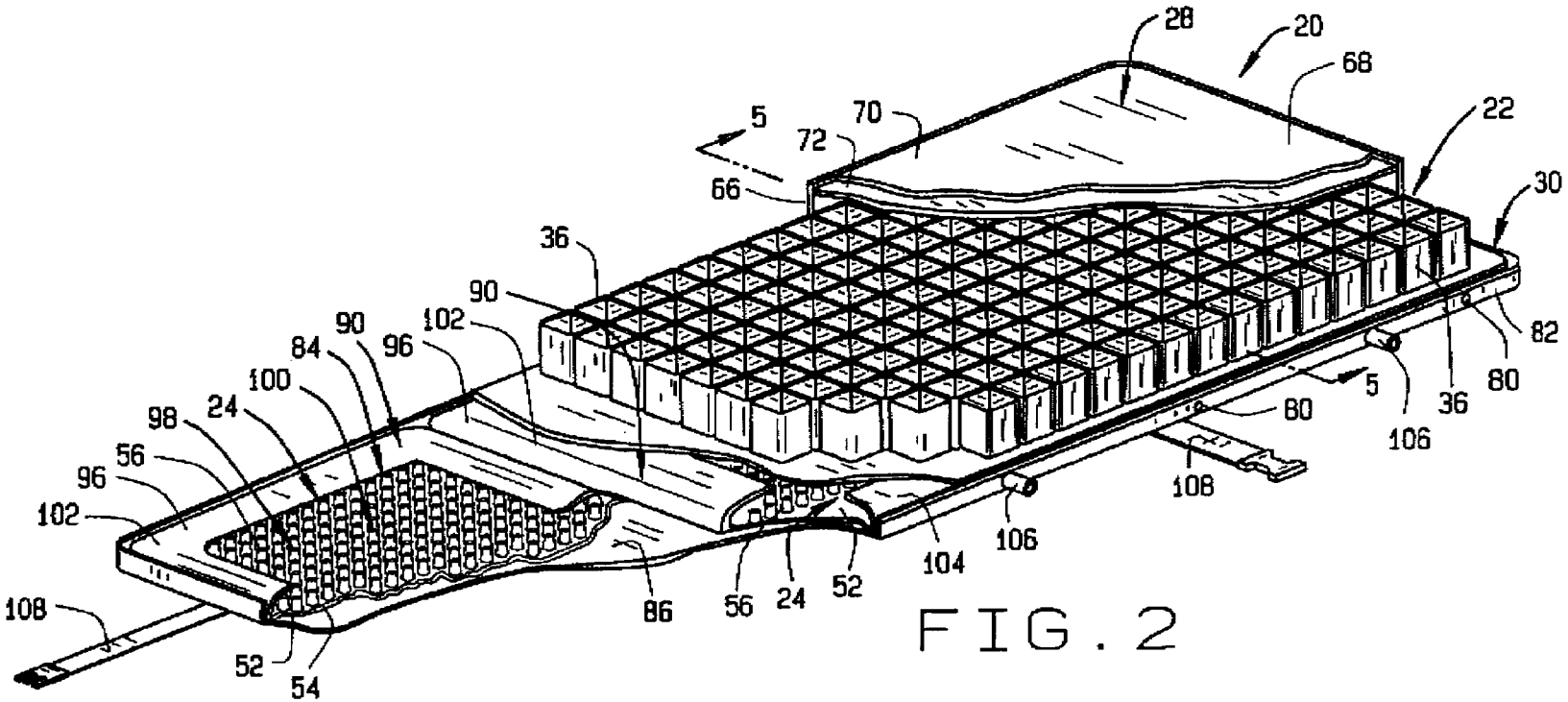
FIG. 2 is a perspective, partially cut-away view of the mattress.
Figure 4:
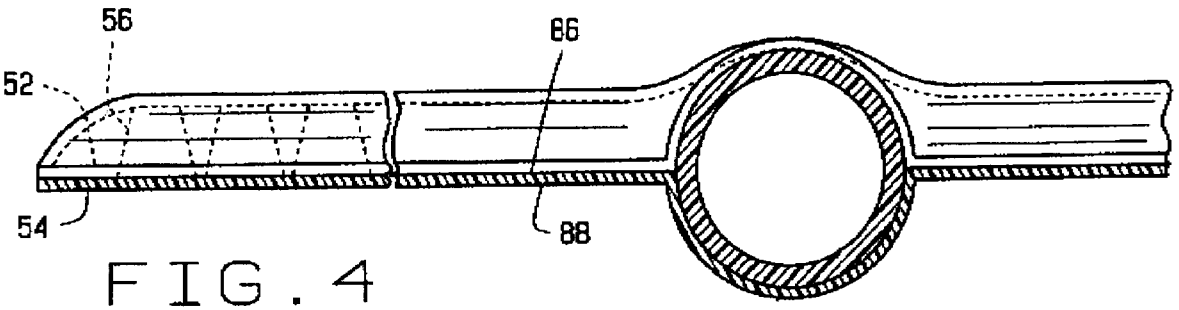
FIG. 4 is a cross-sectional view of a portion of the air channel mat of FIG. 3 taken along line 4—4.
Figure 3:
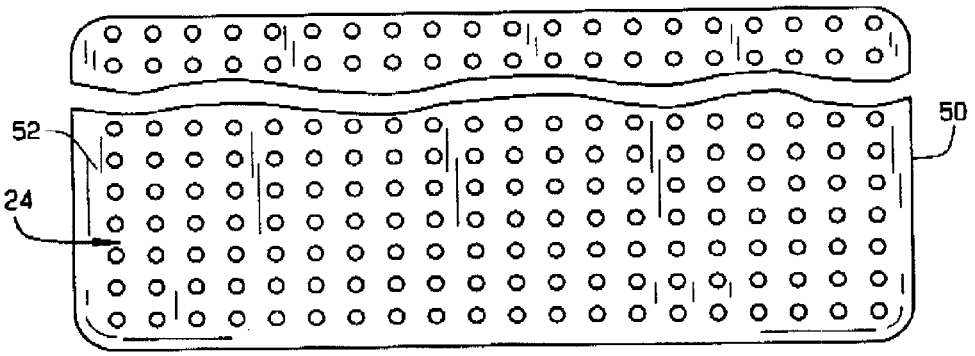
FIG. 3 is a segmented plan view of the top of an air channel mat.

FIG. 1 shows the components of the moisture drying mattress 20. The moisture drying mattress 20 is basically comprised of an air cell mattress 22, a plurality of air channel mats 24, a cover 26 having a top sheet 28 and a bottom sheet 30, and a controller 32 containing an air pump 34.

Figure 8:
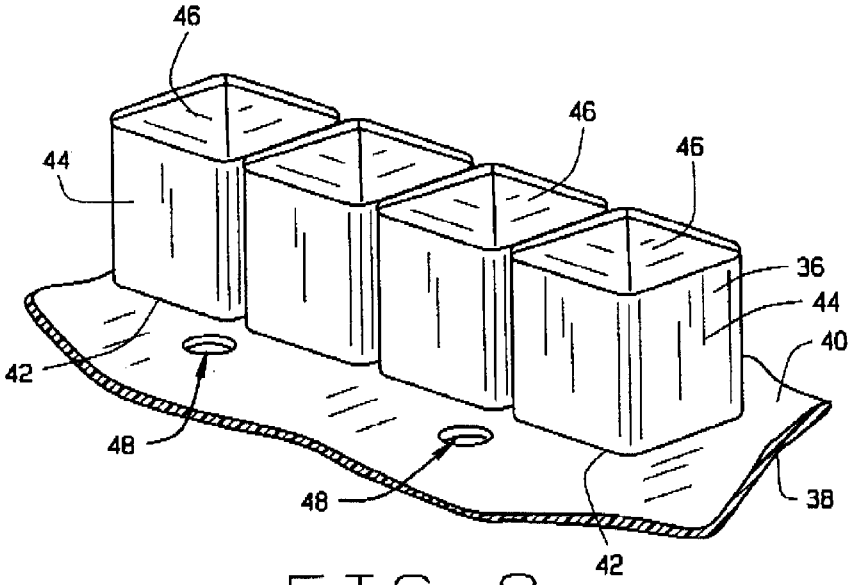
FIG. 8 is a partial cut-away view of some of the air cells of the air cell mattress showing the apertures extending through the air cell mattress.

The air cell mattress 22 could be any of a variety of commercially available air cell mattresses so long as the commercially available air cell mattress has apertures that extend through the air cell mattress to enable a flow of air to pass from beneath the air cell mattress upwardly through the apertures and between the air cells and to the cover top sheet 28. In the preferred embodiment, the air cell mattress 22 is comprised of a plurality of air cells 36. The air cell mattress 22 is constructed in a similar manner to that of the air cell mattresses described in U.S. Pat. Nos. 5,561,875 and 5,596,781, incorporated herein by reference. The air cell mattress 22 is comprised of a generally flat base sheet 38 and a top sheet 40 as best seen in FIG. 8, each made from an air impervious material such as vinyl, neoprene or other types of plastic. The air cell mattress top sheet 40 is molded to form a plurality of air cells 36 and is fixed to the air cell mattress base sheet 38. The air cell mattress top sheet 40 is fixed to the air cell mattress base sheet 38 around the bottom edges 42 of the air cells 36, except for portions of the air cell bottom edges 42 that are left open between the air cell mattress top sheet 40 and the air cell mattress base sheet 38. These portions of the air cell bottom edges communicate with internal air channels (not shown) left open between the air cell mattress top sheet 40 and the air cell mattress base sheet 38 that provide a path for air flow between the air cells 36. Each air cell 36 preferably has a generally cubical shape with four walls 44 extending outwardly from the air cell mattress base sheet 38. A triangular panel 46 extends from the top-most edge of each of the walls 44 and the triangular panels 46 come together to define a pyramidal or dome shaped surface at the top of each of the independent air cells 36. Additionally, there are a plurality of apertures 48 that extend through the air cell mattress base sheet 38 and top sheet 40 but do not communicate with the air cells 36. The apertures 48 provide a flow path for a flow of air supplied by the air pump 34 to flow upwardly from beneath the air cell mattress 22 through the apertures 48 and between the air cells 36 as will be explained.

While the preferred embodiment utilizes the air cell mattress 22 described, it should be understood that any type of cushion, including a cushion that does not distribute the supporting forces over large areas of a user's body, that has a plurality of apertures extending through the cushion providing a flow path for an air flow from the air pump 34 can be utilized with the other component parts of the invention to be described.

Figure 3A:
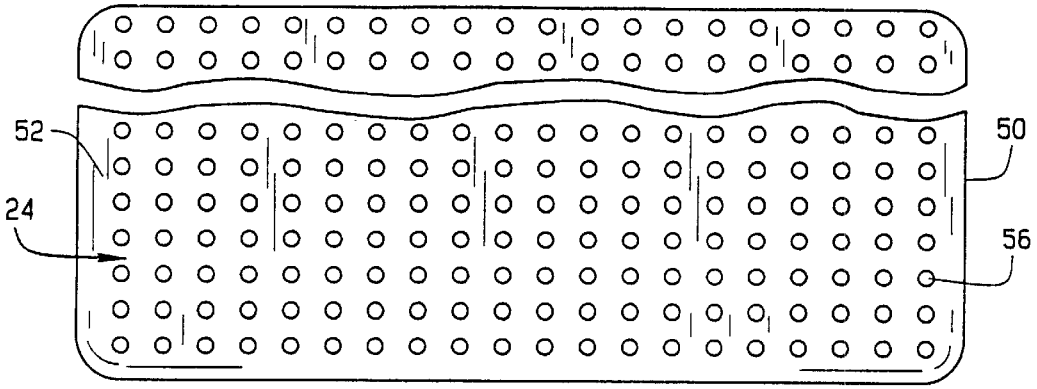
FIG. 3A is a segmented plan view of the top of an air channel mat.

In one preferred embodiment shown in FIG. 3A, the air channel mats 24 each have a peripheral edge 50 that separates opposite top and bottom surfaces 52, 54 of the air channel mats 24. A plurality of projections 56 extend upwardly from the air channel mat top surface 52. The mats with their projections are preferably molded of plastic. The projections 56 are generally conical with their apexes being truncated. The plurality of projections 56 engage with the air cell mattress base sheet 38 to support the air cell mattress base sheet 38 in a spaced relation above the air channel mat top surface 52 to thereby allow a flow of air to flow between the air channel mat top surface 52 and the air cell mattress base sheet 38. While the plurality of projections 56 have been shown as truncated cones, it is to be understood that any configuration of the projections that will support the air cell mattress base sheet 38 in a spaced relation from the air channel mat top surface 52 will suffice. While the air channel mats 24 are shown as being rectangular, it should be understood that any configuration for the air channel mats 24 that can reside beneath the air cell mattress 22 can be utilized without departing from the scope of the invention. In addition, although three air channel mats are preferred, other numbers could be employed.

Figure 3B:
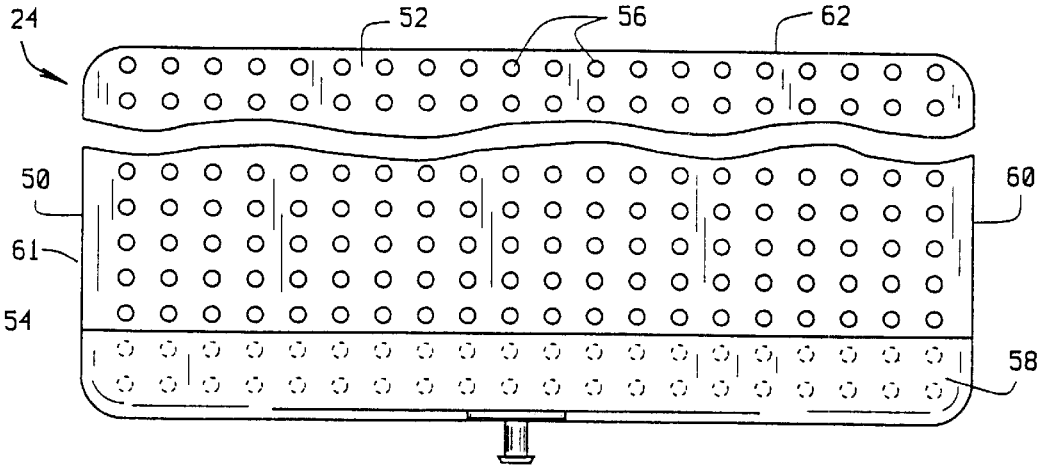
FIG. 3B is a segmented plan view of the top of an alternative embodiment of the air channel mat.

In another preferred embodiment, the air channel mats 24 each have a skirt 58, as can best be seen in FIG. 3B, that is attached to the peripheral edge 50 along one side 59 of the mat and along portions of adjacent sides 60, 61 of the mat 24. The skirt 58 extends over a portion of the projections 56 and the air channel mat top surface 52. Also included along the skirt side 59 of the air channel mat is an air supply connector 64. The skirt 58 goes over the air supply connector 64 so that the air supply connector 64 is sealed between the air channel mat top surface 52 and the skirt 58. The air supply connector 64 is dimensioned and adapted to receive a flow of air from the air pump 34. In the preferred embodiment, the skirt 58 is attached to the peripheral edge 50 by heat welding or heat sealing the skirt 58 to the air channel mat 24. The heat sealing of the skirt 58 to the air channel mat 24 provides an air tight engagement between the skirt 58, the air supply connector 64, and the air channel mat 24. The skirt serves to secure the air supply connector 64 to the air channel mat 24 and also to direct air flowing through the air supply connector 64 over the air channel mat top surface 52. The air pump 34 is connected to each air supply connector 64 by tubing 65. The tubing 65 provides a flow path for a flow of air between the air pump 34 and the air supply connectors 64.

Figure 5:
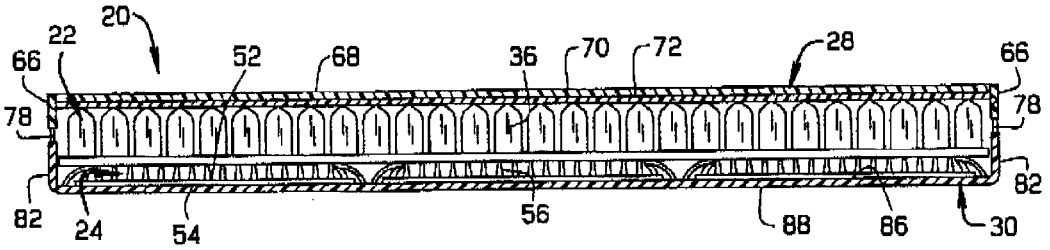
FIG. 5 is a cross-sectional view of the mattress of FIG. 2 taken along line 5—5.

In the preferred embodiment, the cover top sheet 28 has a peripheral edge 66 that extends around a top surface 68 of the cover top sheet 28. The cover top sheet top surface 68 is preferably comprised of a sheet of nylon 70 laminated to a sheet of urethane 72, as can best be seen in FIG. 5. The nylon sheet 70 provides a smooth surface for the interface between a user and the moisture drying mattress 20. The use of a nylon sheet 70 laminated to a urethane sheet 72 provides a cover top sheet top surface 68 that is vapor permeable and liquid impermeable. A flap 74 is attached to the cover top sheet 28 along one side 76 of the cover top sheet. A zipper 78 is located along a portion of the cover top sheet peripheral edge 66. The flap 74 has snaps 80 for selectively attaching the flap 74 to the cover bottom sheet 30. The flap 74 serves to cover a portion of the zipper 78 and the connections between the tubing 65 and the air channel mats 24. The zipper 78 serves to selectively connect a portion of the cover top sheet 28 to a complementary portion of the cover bottom sheet 30. While a nylon sheet 70 laminated to a urethane sheet 72 is used to provide a cover top sheet 28 that is vapor permeable and liquid impermeable, it should be understood that other materials may be utilized to make the cover top sheet 28 vapor permeable and liquid impermeable without departing from the scope of the invention.

In the preferred embodiment, the cover bottom sheet 30 has a peripheral edge 82. A mating half of the zipper 78 runs along a portion of the cover bottom sheet peripheral edge 82. Preferably, the cover bottom sheet 30 is connected to the cover top sheet 28 along complementary portions of the cover bottom sheet peripheral edge 82 and cover top sheet peripheral edge 66. The remaining portions of the cover bottom sheet peripheral edge 82 and cover top sheet peripheral edge 66 are selectively connectable by the zipper 78. While the cover top sheet 28 and cover bottom sheet 30 have been described as being connected along a portion of their respective peripheral edges 66, 82 and selectively connectable zipper 78, it should be understood that the cover top sheet 28 and cover bottom sheet 30 could be selectively connectable (for example by a zipper) around their entire respective peripheral edges 66, 82. It should also be understood that while the cover top sheet 28 and cover bottom sheet 30 are selectively connectable by a zipper 78, any means of selectively connecting the cover top sheet 28 to the cover bottom sheet 30 can be employed without departing from the scope of the invention. Preferably, the cover bottom sheet 30 is constructed out of a flexible plastic material that is both liquid and air impermeable. However, it should be understood that the use of rigid or less pliable materials, that are both liquid and air impermeable, in constructing the cover bottom sheet 30 is also possible without departing from the scope of the invention.

In the preferred embodiment, the cover bottom sheet 30 has pockets 84 that are each dimensioned and adapted to receive an air channel mat 24. The pockets 84 separate the air channel mats 24 and secure the air channel mats 24 to the cover bottom sheet 30. The cover bottom sheet 30 has opposite top and bottom surfaces 86, 88. The pockets 84 are on the cover bottom sheet top surface 86. When an air channel mat 24 is inserted into a pocket 84, the pocket 84 and the cover bottom sheet top surface 86 enclose the air channel mat bottom surface 54 and a portion 89 of the air channel mat top surface 52. The pockets 84 form a seal between the pocket 84 and the air cell mattress base sheet 38 to direct a flow of air from the air pump 34 across the air channel mat top surface 52 and upwardly through the apertures 48 in the portion of the air cell mattress 22 above the air channel mat 24 residing within the pocket 84. While the moisture drying mattress 20 is shown as containing three air channel mats 24 and having three pockets 84, it should be understood that any number of air channel mats 24 and pockets 84 can be employed without departing from the scope of the invention.

Figure 6:
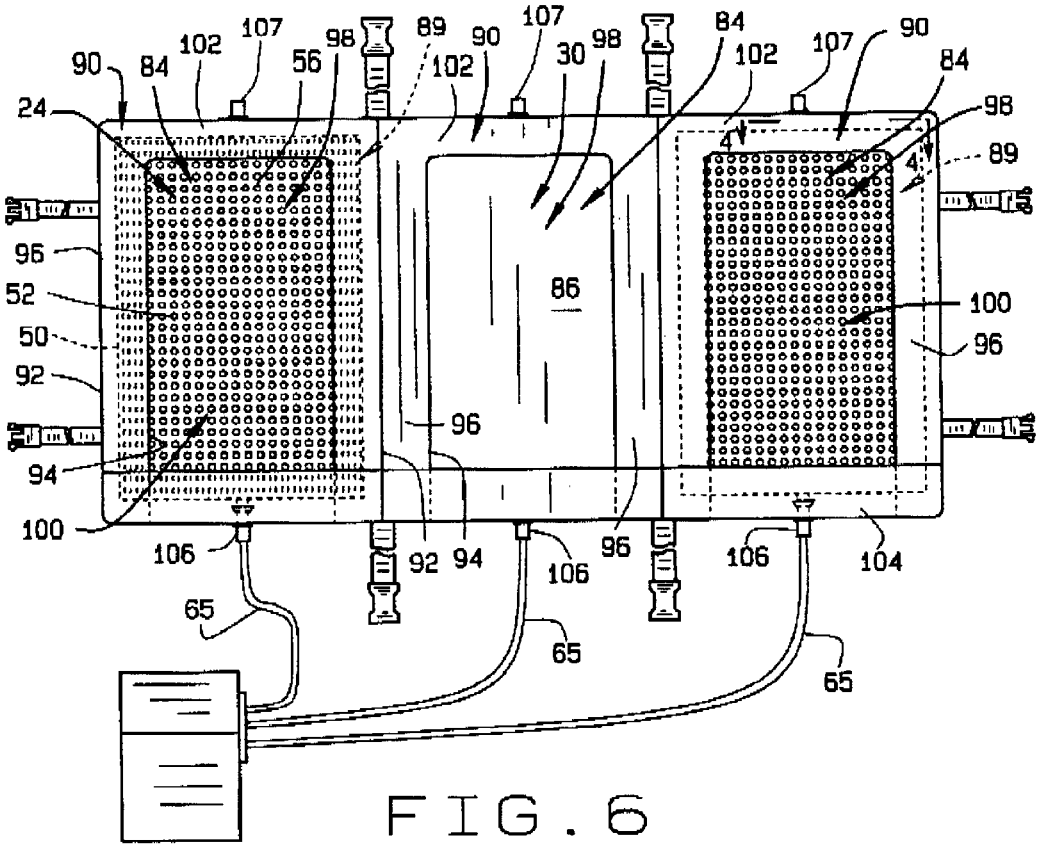
FIG. 6 is a plan view of the top surface of the cover bottom sheet showing the air channel mats inserted in two of the pockets.

Preferably, each pocket 84 is comprised of a frame 90 that is constructed of the same material as the cover bottom sheet and is attached to the bottom sheet top surface 86. The frame 90, as can best be seen in FIG. 6, has a general U-shape with an outer peripheral edge 92, an inner peripheral edge 94, and a margin 96 extending between the outer and inner peripheral edges 92, 94. The frame outer peripheral edge 92 is secured to the bottom sheet top surface 86 and the frame inner peripheral edge 94 defines an opening 98 in the frame 90. The enclosed portion 89 of the air channel mat top surface 52 is enclosed by the overlapping frame margin 96. An exposed portion 100 of the air channel mat top surface 52 in the frame opening 94 is exposed to the air cell mattress base sheet 38. The plurality of projections 56 located on the exposed portion 100 engage with the air cell mattress base sheet 38. In the preferred embodiment, an elongated panel 104 overlaps and completes each of the frames that surround the frame openings 98.

While the pockets 84 have been described as being comprised of the U-shaped frames and the elongated panel, it should be understood that any type of configuration may be utilized for the pockets that separates the air channel mats 24 and provides a seal between the pockets 84 and the air cell mattress base sheet 38 without departing from the scope of the invention.

Figure 7:
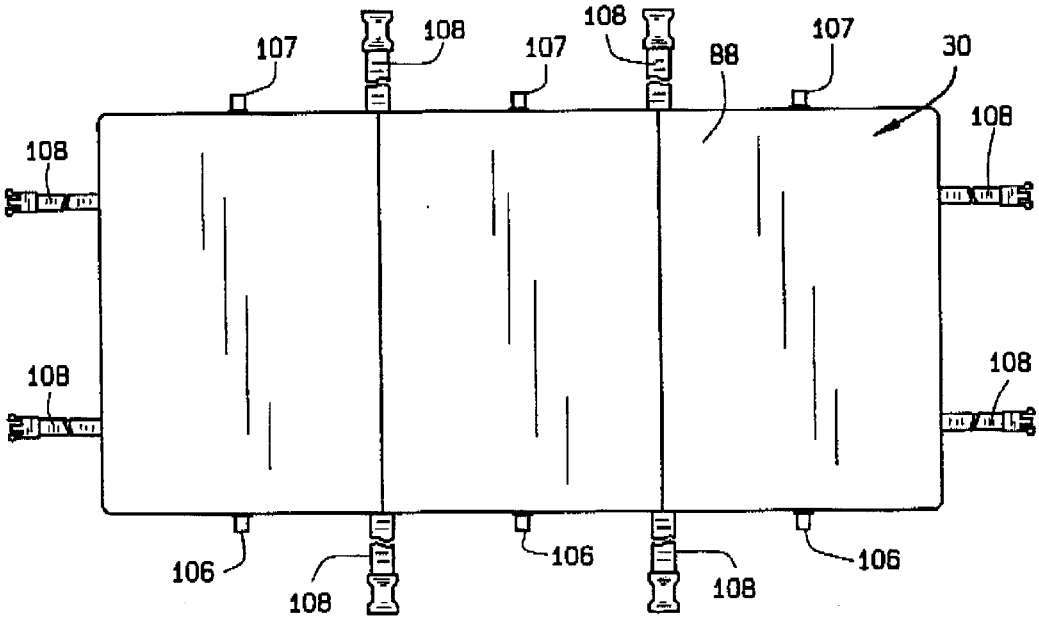
FIG. 7 is a plan view of the bottom surface of the cover bottom sheet.
Figure 9:
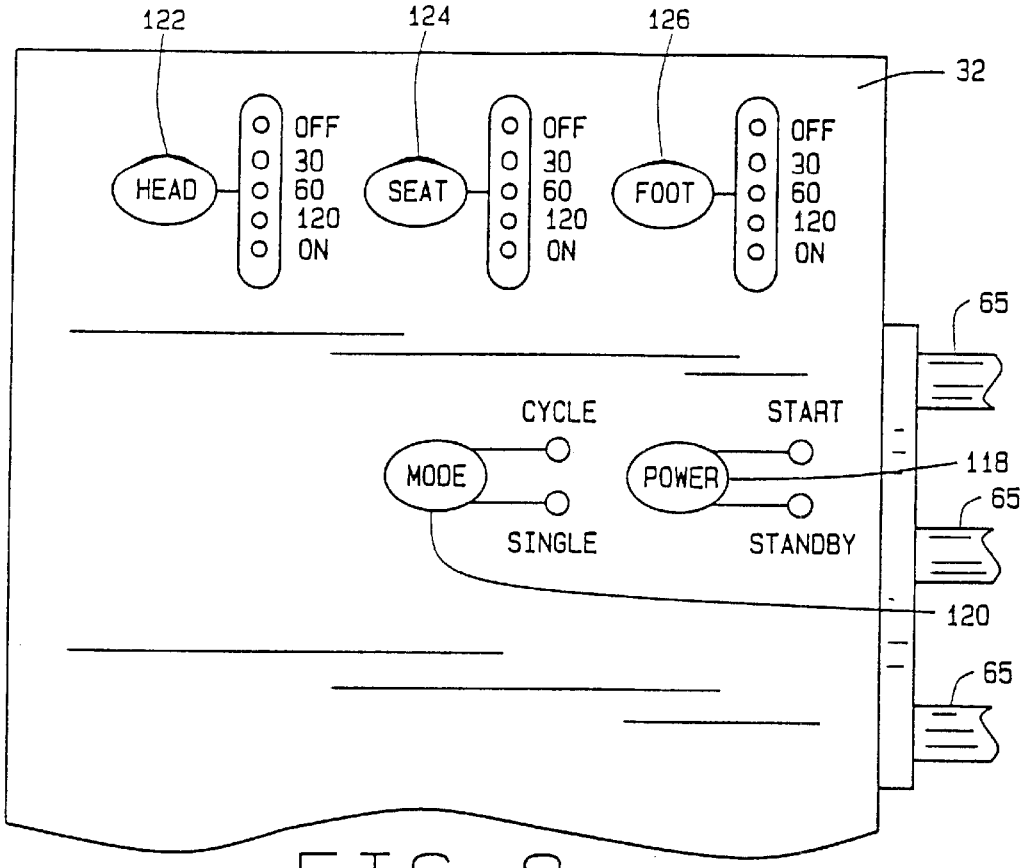
FIG. 9 is a plan view of a portion of the top of the air pump controller.

In the preferred embodiment, the cover bottom sheet peripheral edge 82 has a plurality of snaps 80 and a plurality of air supply connectors 106 along one side of the bottom sheet and a plurality of air vents 107 along an opposite side of the bottom sheet. The connectors 106 and vents 107 are centered relative to the pockets 84 for the air channel mats 24 and are sealed between the bottom sheet top surface 86 and the elongate panel 104 of the frame 90. The air pump 34 is connected to each air supply connector 106 by tubing 65. The tubing 65 provides a flow path for a flow of air between the air pump 34 and the air supply connectors 106. The snaps 80 in the cover bottom sheet peripheral edge 82 engage with the snaps 80 on the top sheet flap 74 to selectively connect flap 74 to the cover bottom sheet peripheral edge 82. The air supply connectors 106 on the cover bottom sheet peripheral edge 82 are designed to allow for the tubing 65 from the air pump 34 to be connected to the air supply connectors 106. As can best been seen in FIG. 7, the cover bottom sheet bottom surface 88 is provided with a plurality of straps 108 that extend outwardly from the cover bottom sheet 30. The straps 108 serve to secure the moisture drying mattress 20 on a desired support surface (not shown), such as a bed in a hospital room. The air vents 107 along the opposite side of the cover bottom sheet peripheral edge 82 from the air supply connectors 106 allow air supplied to the connectors 106 to pass through the air channel mats 24 and to vent from the mattress through the vent openings 107 on the opposite side of the cover bottom sheet 30. While the connectors 106 and vents 107 in the bottom cover sheet 30 have been described as being on the cover bottom sheet peripheral edge 82, it should be understood that the connectors 106 and vents could be in any portion of either the cover bottom sheet 30 or cover top sheet 28 that is convenient for the construction and use of the moisture drying mattress 20 without departing from the scope of the invention.

Figure 10:
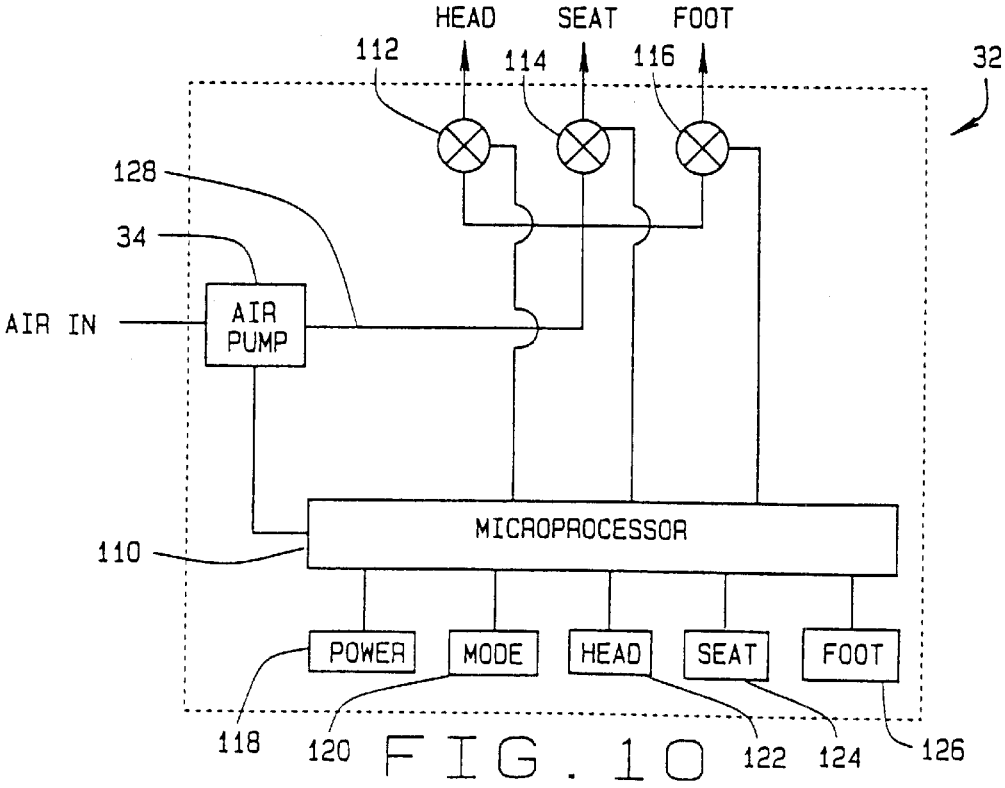
FIG. 10 is a schematic diagram of the operation of the controller of FIG. 9.

In the preferred embodiment, the controller 32, as can best been seen in the schematic of FIG. 10, includes the air pump 34, a microprocessor 110, a plurality of valves 112,114,116, and a plurality of adjustable inputs 118,120,122,124,126 to control air flow to the air channel mats 24. The plurality of valves comprise three valves with each valve being associated with one of the three air channel mats 24 and designated as head, seat and foot valves 112, 114, 116 respectively. The valves 112, 114, 116 are selectively positionable between opened and closed positions. Each valve 112, 114, 116 is connected to the output 128 of the air pump 34 and selectively allows a flow of air from the air pump 34 to flow through the valve 112, 114, 116, through the tubing 65, and to the associated air channel mat 24. The valves 112, 114, 116 allow an air flow from the air pump 34 to flow through the valves 112, 114, 116, through the tubing 65, and to the associated air channel mats 24 when in the opened position. The valves 112, 114, 116 prevent an air flow from the air pump 34 from flowing through the valves 112, 114, 116, through the tubing 65, and to the associated air channel mats 24 when in the closed position. Each valve 112, 114, 116 is independently positionable between the opened and closed position and are controlled by the microprocessor 110.

In the preferred embodiment, the plurality of selectively adjustable inputs include a power input 118, a mode input 120, and inputs for the head, seat, and foot 122, 124, 126 respectively. The power input 118 is selectively adjustable between a start mode and a standby mode. The start mode corresponding to allowing a supply of power to the controller 32 and activating the controller 32. The standby mode corresponding to preventing the supply of power to the controller 32 and the activation of the controller 32. The head, seat and foot inputs 122, 124, 126 are each associated with a corresponding valve 112, 114, 116 respectively. The head, seat, and foot inputs 122, 124, 126 are each independently operated and each selectively controls the operation of the air pump 34 and the associated valve, 112, 114, 116. The head, seat, and foot inputs 122, 124, 126 are each selectively adjustable between three operational settings. The first operational setting corresponds to de-activating the air pump 34 and closing the associated valve 112, 114, 116 to prevent an air flow to the associated air channel mat 24. The second operational setting corresponds to activating the pump and opening the associated valve 112, 114, 116 for one of three selectable time intervals, and then de-activating the air pump 34 and closing the associated valve 112, 114, 116 after the expiration of the selected time interval. The three selectable time intervals are 30 minutes, 60 minutes, and 120 minutes. The third operational setting corresponding to activating the pump and opening the associated valve 112, 114, 116. It should be understood that the head, seat, and foot inputs 122, 124, 126 are independent of each other and regardless of which operational setting each of the head, seat, and foot inputs 122, 124, 126 are operating in, the different operational settings will not interfere with or disable each other. (i.e., when the head input 122 is in the first operational setting and de-activating the air pump 34, the head input 122 will not cause the seat or foot inputs 124, 126 to not function according to their operational settings by preventing or disrupting the activation of the air pump 34)

The mode input 120 controls the operation of the second operational setting of the head, seat, and foot inputs 122, 124, 126 and is selectively adjustable between two modes. The first mode input setting corresponds to continuous cycling of the second operational setting between activating the air pump 34 and opening the associated valve 112, 114, 116 for the selected time interval and de-activating the air pump 34 and closing the associated valve 112, 114, 116 for the selected time interval. The second mode input setting corresponds to a single operation of the second operational setting which activates the air pump 34 and opens the associated valve 112, 114, 116 for the selected time interval and then de-activates the air pump 34 and closes the associated valve 112, 114, 116. While the second operational setting of the head, seat, and foot inputs 122, 124, 126 has been described as controlling the activation and de-activation of the air pump 34 and the opening and closing of the associated valves 112, 114, 116 for specific selectable time intervals, it is to be understood that any selectable time intervals can be employed or the user could enter any desired time interval without departing from the scope of the invention.

In use, a user of the moisture drying mattress 20 would begin by selectively adjusting the power input 118 to the start mode. The user would then select which parts of the moisture drying mattress 20 are to receive a flow of air from the air pump 34. If the user desired to have the head portion of the moisture drying mattress 20 receive a flow of air from the air pump 34, the user would selectively adjust the head input 122 to either the second or third operational setting, thereby activating the air pump 34 and opening the associated head valve 112. The user could then, if desired, follow the same procedure for the seat and foot portions of the moisture drying mattress 20 to have those portions receive a flow of air from the air pump 34. If the user desires to prevent a flow of air to the head, seat, and/or foot portions of the moisture drying mattress 20, the user would selectively adjust the head, seat, and/or foot inputs 122, 124, 126 to the first operational setting. If the user desired to have the air flow from the air pump 34 cycle between supplying air to the desired portion of the moisture drying mattress 20 for a selected time interval and not supplying air to the desired portion of the moisture drying mattress 20 for the selected time interval, the user would select one of the selectable time intervals in the second operational setting and adjust the mode input 120 to the cycle setting. If the user desired to have the air flow from the air pump 34 flow to a portion of the moisture drying mattress 20 for a single selected time interval, the user would adjust the head, seat, and/or foot inputs 122, 124, 126 to the desired second operational setting and adjust the mode input 120 to the single setting. The user can thereby control what portions of the moisture drying mattress 20 receive a flow of air and the duration of that flow of air.

While the present invention has been described by reference to specific embodiments, it should be understood that modifications and variations of the invention may be constructed without departing from the scope of the invention as defined by the following claims.

What is claimed is:

1. A moisture drying cushion comprising:

at least one cushion having opposite top and bottom surfaces and a plurality of apertures extending through the cushion from the bottom surface to the top surface;

a plurality of air channel mats, each air channel mat having a base with at least one support on the base, each air channel mat being dimensioned and adapted to fit beneath the at least one cushion and support the at least one cushion bottom surface in a spaced relation from the base;

a cover dimensioned and adapted to enclose the at least one cushion and the air channel mats, the cover having at least one surface that is vapor permeable and liquid impermeable, each said air channel mat defining a separate vapor drying zone within said cover; and a selectively operable air pump for selectively supplying an air flow to the plurality of air channel mats, the air flow supplied to the mats flowing over the mats between the base and the cushion bottom surface and upwardly through the cushion apertures to remove moisture vapor by a flow of air to a vapor drying zone.

2. The moisture drying cushion of claim 1, wherein:

the plurality of air channel mats each have a peripheral edge separating opposite top and bottom surfaces of the base, an air supply connector, and a plurality of projections along the base, the plurality of projections forming said at least one support extending upwardly from the base top surface and engaging with the at least one cushion bottom surface to support the at least one cushion bottom surface in a spaced relation from the base top surface.

3. The moisture drying cushion of claim 2, wherein:

the air pump has an outlet that communicates with the air supply connectors of the plurality of air channel mats to supply an air flow to said vapor drying zones by supplying air flow to the mats that define the vapor drying zones, wherein said air flows over the base top surfaces of the mats between the projections and the cushion bottom surface and upwardly through the cushion apertures.

4. The moisture drying cushion of claim 3, wherein:

the air pump outlet is a plurality of air outlets, each outlet being connected to a valve that is selectively positionable between opened and closed positions, the valves being connected between the outlets and the air supply connectors of the air channel mat, each valve being associated with one air channel mat and allowing a flow of air from the air pump through the valve and into the associated air channel mat when in the opened position and preventing a flow of air from the air pump through the valve and into the associated air channel mat when in the closed position, thereby allowing a user to selectively choose which vapor drying zone receive an air flow from the air pump.

5. The moisture drying cushion of claim 4, further comprising:

an air supply controller for selectively controlling a flow of air to any of said vapor drying zones, the controller being connected to the valves and the air pump and having a plurality of selectively adjustable inputs, the inputs controlling the opening and closing of the valves and the operation of the air pump.

6. The moisture drying cushion of claim 5, wherein:

the inputs control cyclic opening and closing of the valves for predetermined periods of time.

7. The moisture drying cushion of claim 1, wherein:

the at least one surface is a op surface of the cover and is comprised of a nylon sheet laminated to a urethane sheet.

8. The moisture drying cushion of claim 2, wherein:

the at least one cushion is an air cell mattress comprised of a plurality of air cells.

9. The moisture drying cushion of claim 8, wherein:

the air cell mattress is further comprised of at least one air impervious base sheet and at least one air impervious top sheet, the air impervious top sheet is preformed with the plurality of air cells and is secured to the base sheet with the air cells extending outwardly from the base sheet, the air cells are interconnected to permit air flow therebetween, and the apertures extend through the base sheet and top sheet and do not communicate with the air cells.

10. A moisture drying cushion comprising:

at least one cushion having opposite top and bottom surfaces and a plurality of apertures extending through the cushion from the bottom surface to the top surface;

a plurality of air channel mats, each mat having a base and being dimensioned and adapted to fit beneath the at least one cushion and support the at least one cushion bottom surface in a spaced relation from the base, the plurality of air channel mats each have a peripheral edge separating opposite top and bottom surfaces of the base, an air supply connector, and a plurality of projections along the base, the plurality of projections extending upwardly from the base top surface and engaging with the at least one cushion bottom surface to support the at least one cushion bottom surface in a spaced relation from the base top she a selectively operable air pump for selectively supplying an air flow to the plurality of air channel mats, the air flow supplied to the mats flowing over the mats between the base and the cushion bottom surface and upwardly through the cushion apertures to remove moisture and supply a flow of air to a user of the moisture drying cushion;

a cover having a top sheet with a peripheral edge and a bottom sheet with a peripheral edge, the top sheet and bottom sheet being connected together along portions of their peripheral edges leaving an opening between their peripheral edges that provides access to an interior of the cover between the top sheet and bottom sheet, the bottom sheet having a plurality of pockets in the cover interior that are each dimensioned and adapted to receive one of the plurality of air channel mats in the pockets, each pocket covering the entire base bottom surface and a portion of the base top surface leaving an exposed portion of the base top surface where the projections of the exposed portion of the base top surface engage with the cushion bottom surface.

11. The moisture drying cushion of claim 10, wherein:

the pockets separate the air channel mats and form a seal between the pockets and the cushion bottom surface.

12. A moisture drying cushion comprising:

at least one cushion having opposite top and bottom surfaces and a plurality of apertures extending tough the cushion from the bottom surface to the top surface; an air distribution member having a base with a peripheral edge and opposite top and bottom surfaces, the air distribution member being dimensioned and adapted to fit beneath the at least one cushion bottom surface and support the at least one cushion bottom surface in a spaced relation from the base top surface; an air supply pump communicating with the air distribution member to supply an air flow to the air distribution member and across the air distribution member between the base top surface and the at least one cushion bottom surface and through the plurality of apertures in the at least one cushion; and a cover dimensioned and adapted to enclose the at least one cushion and the air distribution member, the cover further comprising a top sheet with a peripheral edge and a bottom sheet with a peripheral edge, the top sheet and bottom sheet being connected together along portions of their peripheral edges leaving an opening between their peripheral edges that provides access to an interior of the cover between the top sheet and bottom sheet, the top sheet having the top surface and the bottom sheet having at least one pocket in the cover interior that is dimensioned and adapted to receive the air distribution member in the at least one pocket, the at least one pocket covering the entire base bottom surface and a portion of the base top surface leaving an exposed portion of the base top surface, at least one surface being vapor permeable and liquid impermeable.

13. The moisture drying cushion of claim 11, wherein:

the at least one pocket forms a seal between the pocket and the cushion bottom surface.

14. The moisture drying cushion of claim 12, wherein:

the air distribution member is one of a plurality of air distribution members, each air distribution member communicating with the air supply pump and being independently supplied with an air flow from the air pump; and the at least one pocket is a plurality of pockets, the plurality of pockets separating the plurality of air distribution members and forming a seal between the pockets and the cushion bottom surface.

15. The moisture drying cushion of claim 12, further comprising:

a plurality of valves equal in number to the plurality of air distribution members, each valve being associated with one of the plurality of air distribution members and located between the associated air distribution member and the air supply pump, the valves being selectively positionable between opened and closed positions and allowing the air flow to flow from the air pump to the associated air distribution member when in the opened position and preventing the air flow from the air pump from flowing to the associated air distribution member when in the closed position; and an air flow controller for controlling the air flow to each of the plurality of air distribution members, the controller being connected to the valves and the air pump and having a plurality of selectively adjustable inputs, the inputs controlling the opening and closing of the valves and the operation of the air pump.

16. The moisture drying cushion of claim 15, wherein: the inputs control cyclic opening and closing of the valves for predetermined periods of time.

17. A moisture drying cushion comprising:

at least one cushion having opposite top and bottom surfaces and a plurality of apertures extending through the cushion from the bottom surface to the top surface;

a plurality of independent air distribution members each having a base with a peripheral edge and opposite top and bottom sides, the air distribution members being dimensioned and adapted to fit beneath the at least one cushion bottom surface and support the at least one cushion bottom surface in a spaced relation from the base top side;

a bottom sheet with a peripheral edge, the bottom sheet having opposite top and bottom surfaces, the bottom sheet top surface having a number of pockets equal to the number of air distribution members, each of said pockets being dimensioned and adapted to receive one said air distribution member and enclose the base bottom side and a portion of the base top side of the at least one air distribution member and thereby separating said air distribution members;

a selectively operable air pump for selectively supplying an air flow to the air distribution members, the air flow flowing across the air distribution member between the air distribution member top side and the cushion bottom surface and upwardly through the cushion apertures;

a plurality of valves equal in number to the number of air distribution members, each valve being associated with one air distribution member and located between the associated air distribution member and the air pump, the valves being positionable between opened and closed positions and allowing an air flow from the air pump to the associated air distribution members when in the opened position and preventing an air flow from the air pump to the associated air distribution members when in the closed position; and an air controller for controlling air flow to the plurality of air distribution members, the air controller being connected to the valves and the air pump and having a plurality of selectively adjustable inputs, the adjustable inputs controlling the opening and closing of the valves and the operation of the air pump.

18. The moisture drying cushion of claim 17, wherein:

the inputs control cyclic opening and closing of the valves for predetermined periods of time.

19. A moisture drying cushion comprising:

at least one cushion having opposite top and bottom surfaces and a plurality of apertures extending through the cushion from the bottom surface to the top surface; at least one air distribution member having a base with a peripheral edge and opposite top and bottom sides, the air distribution member being dimensioned and adapted to fit beneath the at least one cushion bottom surface and support the at least one cushion bottom surface in a spaced relation from the base top side; a bottom sheet with a peripheral edge, the bottom sheet having opposite top and bottom surfaces, the bottom sheet top surface having at least one pocket, the at least one pocket being dimensioned and adapted to receive the at least one air distribution member and enclose the base bottom side and a portion of the base top side of the at least one air distribution member; and a selectively operable air pump for selectively supplying an air flow to the at least one air distribution member, the air flow flowing across the air distribution member between the air distribution member top side and the cushion bottom surface and upwardly through the cushion apertures; and a cover comprised of a top sheet with a peripheral edge and the bottom sheet with a peripheral edge, the top sheet and bottom sheet are connected along portions of their peripheral edges leaving an opening between their peripheral edges that provides access to an interior of the cover between the top sheet and bottom sheet the at least one pocket being in the cover interior.

20. The moisture drying cushion of claim 19, wherein:

at least a portion of the cover top sheet is vapor permeable and liquid impermeable.

21. The moisture drying cushion of claim 19, wherein:

at least a portion of the cover top sheet is comprised of a nylon sheet laminated to a urethane sheet.

* * * * *